US005547168A

United States Patent [19]

Kelly

[11] Patent Number: 5,547,168

[45] Date of Patent: Aug. 20, 1996

[54] STAKE PULLER ATTACHMENT FOR PRY BARS

[75] Inventor: David L. Kelly, Sacramento, Calif.

[73] Assignee: The Burke Group, Sacramento, Calif.

[21] Appl. No.: 433,089

[22] Filed: May 3, 1995

[51] Int. Cl.[6] ..... E21B 19/00

[52] U.S. Cl. ..... 254/30; 254/131; 254/132

[58] Field of Search ..... 254/29 R, 30, 254/131, 132, 133 R, DIG. 4; 81/124.3, 124.4

[56] References Cited

U.S. PATENT DOCUMENTS

| | | | |
|---|---|---|---|
| 781,638 | 2/1905 | Doan | 254/132 |
| 2,486,022 | 10/1949 | Haist et al. | 81/121 |
| 2,582,284 | 1/1952 | Sarosdy | 254/132 |
| 2,647,723 | 8/1953 | Seppmann | 254/131 |
| 2,777,726 | 1/1957 | Lundgren et al. | 294/92 |
| 3,580,544 | 5/1971 | Payne | 254/131 |
| 3,587,121 | 6/1971 | Morrow | 7/12 |
| 3,641,846 | 2/1972 | Prial | 81/90 |
| 3,779,516 | 12/1973 | King | 254/30 |
| 4,998,312 | 3/1991 | Donaldson | 7/166 |
| 5,009,394 | 4/1991 | Marshall | 254/30 |
| 5,011,117 | 4/1991 | Youngblood et al. | 254/30 |
| 5,022,632 | 6/1991 | Beideck | 254/30 |
| 5,052,659 | 10/1991 | Bates | 254/29 R |
| 5,186,437 | 2/1993 | Scott | 254/30 |
| 5,224,687 | 7/1993 | Geckler, et al. | 254/30 |

FOREIGN PATENT DOCUMENTS 48364 12/1968 Germany .

OTHER PUBLICATIONS

Form-Rite® "Stake Puller" trade publication (one page) (1993).

*Primary Examiner*—Bruce M. Kisliuk
*Assistant Examiner*—Thomas W. Lynch
*Attorney, Agent, or Firm*—Limbach & Limbach L.L.P.

[57] ABSTRACT

An attachment for a conventional pry bar facilitates the bar for use in the pulling of stakes. The attachment comprises a section of pipe which is flattened to provide a tubular portion telescopically receivable over the end of a pry bar and thin edge portion to one side of the tubular portion. The edge portion is formed with a notch proportioned for slidable receipt around a stake to be pulled and gripping engagement with the stake upon cocking of the attachment relative to the stake. In use the stake is cocked for gripping and pulling engagement with the stake by fulcruming the pry bar against a surface adjacent the stake.

6 Claims, 1 Drawing Sheet

STAKE PULLER ATTACHMENT FOR PRY BARS

BACKGROUND OF THE INVENTION

The present invention relates to a stake puller and, more particularly, it is concerned with such a puller which takes the form of an attachment adapted to be connected to a conventional pry bar. In its more specific aspects, the invention is concerned with such an attachment which is formed of a segment of flattened steel pipe.

It is known to provide attachments for pry bars which adapt them for special uses. Such an attachment for use in increasing the leverage advantage of the pry bar may be seen in U.S. Pat. No. 3,587,121. The prior art teaches various types of stake pullers which may be secured to pry bars or jacks; see, for example, U.S. Pat. Nos. 5,009,394, 5,052,659 and 5,224,687. The prior art also teaches tools designed specifically for stake pulling, as may be seen from U.S. Pat. Nos. 2,777,726, 3,779,516, 4,998,312, 5,011,117, 5,022,632 and 5,186,437. At least one specially designed puller of the latter type employs a plate with a slot proportioned for slidable receipt around a stake to be pulled and gripping engagement with the stake upon cocking of the plate relative to the stake. The plate of latter puller, however, is not adapted for use in converting a conventional pry bar to a stake puller.

SUMMARY OF THE INVENTION

The attachment of the present invention comprises a body having a socket proportioned for telescopic engagement over the distal end of a pry bar and a thin edge to one side of the socket. A notch in the thin edge is proportioned for slidable receipt around the stake to be pulled and gripping engagement with the stake upon being cocked relative thereto.

The invention is also concerned with a method of making such an attachment by flattening a section of pipe to provide the socket and the thin edge and then forming the notch in the thin edge. In a more specific embodiment of the method, the attachment so provided is engaged over the free distal end of a pry bar to convert the bar into a stake puller.

A principal object of the present invention is to provide an attachment for converting a conventional pry bar into a stake puller.

Another and related object of the invention is to provide such an attachment which is durable and may be inexpensively manufactured.

Still another object of the invention is to provide such an attachment which has stake engaging notches of different sizes to accommodate the pulling of stakes of different diameters.

Yet a further object of the invention is to provide such an attachment which is fabricated of a segment of conventional steel pipe.

A further and more specific object of the invention is to provide such an attachment which may be readily secured to or removed from a pry bar and does not require alteration of the structure of the bar.

Still another object of the invention is to provide such an attachment which does not require special fulcrum, pedestal or support.

A further object of the invention is to provide such an attachment which may ratchet over the surface of a stake to be pulled to accommodate step-wise pulling of the stake.

Another object related to the latter object is to provide such an attachment wherein the stake may be pulled by short strokes which minimize the possibility that the stake will be bent over during the pulling process.

Another object is to provide such an attachment wherein the stake is engaged by a notch formed in a thin section of the attachment which is of such a thickness as to avoid bending of the stake as the attachment imparts lifting movement during the pulling operation.

The foregoing and other objects will become more apparent when viewed in light of the following detailed description and accompanying drawings.

DESCRIPTION OF THE PREFERRED EMBODIMENTS

Figure 1:
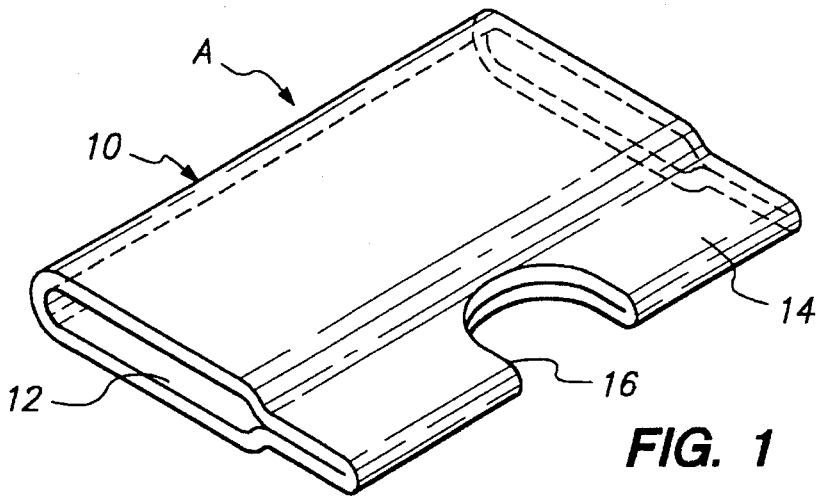
FIG. 1 is a perspective view of a first embodiment of the inventive attachment.
Figure 3:
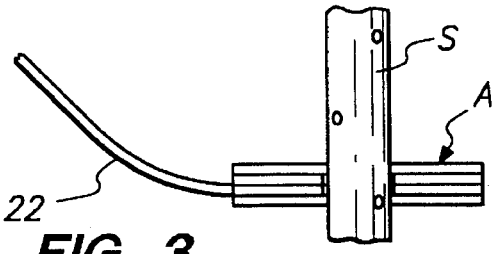
FIG. 3 is a side elevational view of the first embodiment attachment received on the end of a pry bar, as the attachment would appear when slidably received around a stake to be pulled.
Figure 4:
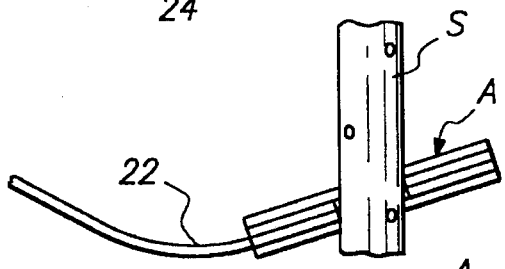
FIG. 4 is a side elevational view similar to FIG. 3, showing the attachment as it would appear when cocked into gripping engagement with the stake during the pulling process.

The first embodiment attachment shown in FIG. 1 is designated in its entirety by "A" and comprises a body 10 having a socket 12 and a thin edge portion 14. A notch 16 is formed in and opens through the side of the edge portion 14. The notch is proportioned for slidable receipt around a stake when the attachment is normal to the stake as shown in FIG. 3 and for gripping engagement with the stake when the attachment is disposed at an angle relative thereto, as shown in FIG. 4.

Figure 5:
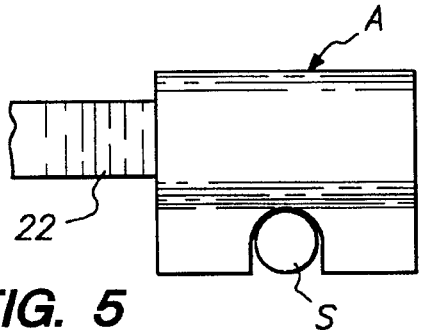
FIG. 5 is a top plan view of the first embodiment attachment received on the end of a pry bar, with a stake received within the notch of the attachment; and, FIG. 6 is a top plan view of a second embodiment of the attachment wherein two notches are provided to accommodate, respectively, stakes of different diameters.

A stake to be pulled by the attachment is shown in FIGS. 2, 3, 4 and 5 and designated "S." From FIG. 5, it can be seen that the notch has a depth sufficient to fully encompass the diameter of the stake. As shown for use with a stake of a round section, the base of the notch 16 is of an arcuate configuration generally complemental to that of the stake.

The attachment "A" is formed by flattening a segment of steel pipe. In one embodiment, the pipe is formed from a three inch long segment of two and one-half inch schedule forty pipe and the socket has a depth of one-half inch and a straight line width of three inches. The edge portion 14 is approximately one inch wide and is formed by folding the sides of the pipe against one another.

Figure 2:
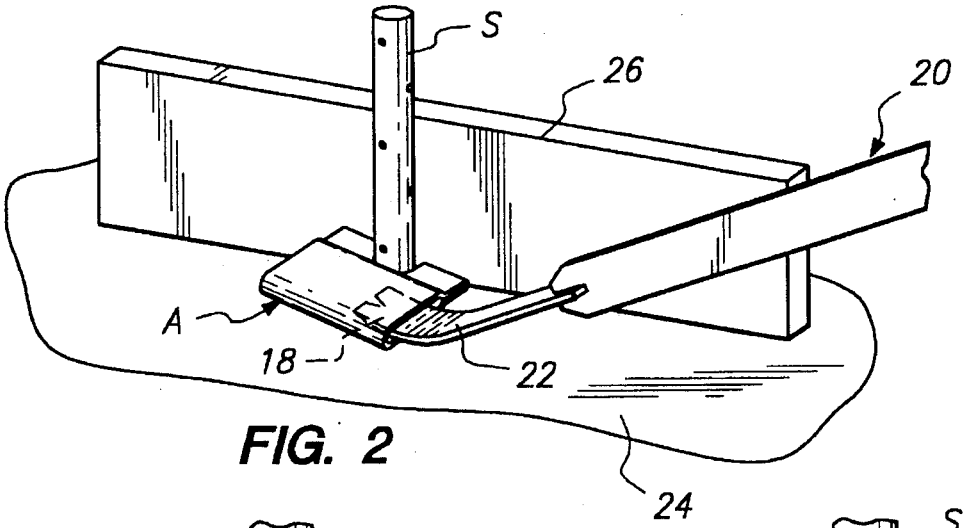
FIG. 2 is a perspective view of the first embodiment attachment received over the end of a pry bar, as the attachment would appear during the process of pulling a stake used to support a concrete form.

FIG. 2 shows the attachment received over the distal end 18 of a pry bar 20. As is conventional, the pry bar is formed with an arcuately curved portion 22 spaced inwardly slightly from the distal end 18. This portion is shown resting upon the surface 24 of the ground in which the stake "S" is driven.

FIG. 2 also shows the stake "S" supporting the side 26 of a form.

In use as shown in FIG. 2, each time the pry bar is pushed down the attachment "A" cocks into gripping and lifting engagement with the stake "S" as shown in FIG. 4. Lifting results as the curved portion 22 fulcrums against the surface 24. Lifting of the pry bar from the position shown in FIG. 2 moves the attachment to a condition radially aligned with the stake "S," as shown in FIG. 3, and permits the attachment to slide down on the stake. Repeated depression and lifting of the pry bar thus functions to ratchet the attachment along the stake and lift the stake in increments with each downward stroke of the pry bar.

Figure 6:
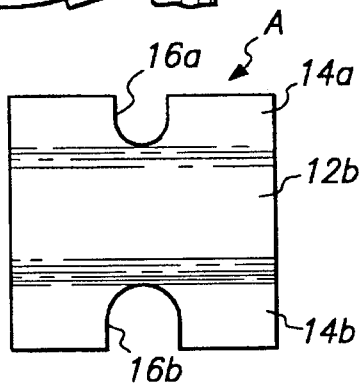

The second embodiment attachment shown in FIG. 6 is designated "$A_1$" and differs from the first embodiment in that it is formed with edge portions 14*a* and 14*b* disposed to either side of a socket portion 12*b*. Edge portion 14*a* is formed with a notch 16*a* proportioned for receipt around a relatively small stake and edge portion 14*b* is formed with a notch 16*b* proportioned for receipt around a larger stake. Thus, the attachment 14*b* is adapted for the pulling of stakes of different diameters.

In use, the second embodiment attachment "$A_1$" is received over the distal end of a pry bar and operates in the same manner as the first embodiment attachment. The only difference is that the second embodiment attachment is designed to accommodate stakes of different diameters. The second embodiment attachment would be formed from a segment of pipe, similarly to the method used to form the first embodiment attachment.

CONCLUSION

While preferred embodiments of the invention have been illustrated and described, it is to be understood that the invention is not intended to be limited to these embodiments, but rather is defined by the accompanying claims.

I claim:

1. A stake puller for attachment to the end of a pry bar, said puller comprising:

a. a section of pipe having a continuous side wall flattened to provide a socket comprised of spaced portions of the side wall configured for telescopic engagement over the end of the pry bar and a thin edge comprised of juxtaposed portions of the side wall to one side of the socket; and, b. a notch formed in the edge, said notch being proportioned for slidable receipt around a stake to be pulled and gripping engagement with the stake upon being cocked relative thereto.

2. A stake puller according to claim 1 wherein side wall of the pipe is flattened to provide thin edges comprised of juxtaposed portions of the side wall on two sides of the socket and a notch is formed in each of said edges, said notches being proportioned, respectively, for slidable receipt around and gripping engagement with stakes of different diameters.

3. A stake puller for attachment to the end of a pry bar, said puller comprising:

a. a three inch length of two and one-half inch schedule 40 steel pipe, said pipe having an interior wall and being flattened to provide a socket for telescopic engagement over the end of the pry bar which is bounded by said wall and is approximately one-half inch deep and three inches wide and a thin edge to the side of the socket; and, b. a notch formed in the edge, said notch being proportioned for slidable receipt around a stake to be pulled and gripping engagement with the stake upon being cocked relative thereto.

4. A stake puller according to claim 3 wherein the thin edge of the pipe is formed by folding one portion of the interior wall of the pipe against another.

5. An attachment for adapting the distal end of pry bar for use as a stake puller, said attachment comprising:

a. a body comprising a section of pipe having a continuous side wall with spaced portions configured to provide a socket for telescopic engagement over the distal end of the pry bar and juxtaposed portions configured to provide a thin edge to one side of the socket; and, b. a notch in said edge proportioned for slidable receipt around a stake to be pulled and gripping engagement with the stake upon being cocked relative thereto.

6. An attachment according to claim 5 wherein the side wall has juxtaposed portions configured to provide thin edges on two sides of the socket and a notch is formed in each of said edges, said notches being proportioned, respectively, for slidable receipt around and gripping engagement with stakes of different diameters.

* * * * *